US006390011B1

(12) United States Patent
Goodman

(10) Patent No.: US 6,390,011 B1
(45) Date of Patent: May 21, 2002

(54) SMART ANCHOR

(76) Inventor: Jack Goodman, 1415 Crabhouse Rd., Lusby, MD (US) 20657

( * ) Notice: Subject to any disclaimer, the term of this patent is extended or adjusted under 35 U.S.C. 154(b) by 0 days.

(21) Appl. No.: 09/947,496

(22) Filed: Sep. 7, 2001

(51) Int. Cl.[7] ..... B63B 21/32
(52) U.S. Cl. ..... 114/301
(58) Field of Search ..... D12/215; 114/294, 114/300–310

(56) References Cited

U.S. PATENT DOCUMENTS 4,433,635 A * 2/1984 Takahashi ..... 114/301
4,802,434 A * 2/1989 Bruce ..... 114/294
4,827,863 A * 5/1989 Scholz et al. ..... 114/301
5,138,967 A * 8/1992 McCarron et al. ..... 114/301
5,469,802 A * 11/1995 Ivicevic ..... 114/301
5,855,181 A * 1/1999 Oxford ..... 114/301
5,934,219 A * 8/1999 Poiraud ..... 114/301

FOREIGN PATENT DOCUMENTS

GB 2083428 * 3/1982 ..... 114/301

* cited by examiner

*Primary Examiner*—S. Joseph Morano
*Assistant Examiner*—Ajay Vasudeva
(74) *Attorney, Agent, or Firm*—Eric P. Schellin

(57) ABSTRACT

A marine anchor having integral flukes which have together a delta configuration. The flukes have a trailing arcuate edge. Each fluke has a wedge cut into the trailing portion to provide extending outer fins. The fins are turned downwardly to provide flaps that produce a self righting anchor and one that results in a horizontal planing when the anchor is pulled.

5 Claims, 5 Drawing Sheets

SMART ANCHOR

BACKGROUND OF THE INVENTION

1. Field of the Invention

The present invention relates to marine anchors.

2. Description of the Prior Art

The basic requirement of a marine anchor is an ability to dig into a mooring bed when pulled forwardly, and to stay stable in the penetrated attitude in the bed as it is pulled further. It is also well established that for high holding power the anchor should be relatively deeply buried during anchor setting. It will be appreciated that the nature of mooring beds varies considerably, for example, from hard soils of granular noncohesive dense gravels and sands; cohesive stiff clays to soft soils of cohesive muds. In some instances the mooring bed may be rocky whereupon the anchor must be able to hook vigorously onto a rock to achieve mooring. Satisfactory operation of an anchor in a particular mooring bed has required the anchor to have a particular geometry including a fluke angle compatible with the mooring bed soil. The fluke angle is the angle formed between the fluke and a line in a fore-and-aft plane of symmetry of the anchor extending between the rear of the fluke and an anchor line attachment point in the forward end of the shank.

An object of the present invention is to provide an improved marine anchor which self-orientates to a ground-engaging attitude when cast in an inverted position on and pulled horizontally over a mooring bed surface. Also continues down by leveling itself with the gradient density.

SUMMARY OF THE INVENTION

The present invention pertains to a marine anchor which is symmetrical about a fore-and-aft plane including a basic anchor structure. The anchor has an arcuate shank which has a first end and a second end. The main portion of the anchor is constructed of arcuate triangular shaped flukes which are integral and terminate in a forwardly extending point. The point constitutes the digging end. The shank extends perpendicularly upwardly and forwardly from said flukes. The second or upper end of the shank terminates in an anchor line attachment means. The termination of the upwardly and forwardly extending shank extends substantially beyond the point defined by the flukes. The first end of the shank is affixed to the flukes at a point rearwardly from the forwardly extending point at substantially aft of a mid-point of the flukes.

The flukes together define an approximate delta shaped configuration and defines a longitudinal configuration with the end of the shank at the bottom of the arc and the flukes curving upwardly about the shank. The flukes terminate rearwardly in a substantially horizontally disposed arcuate trailing edge. Each fluke has a wedge shaped cut-out resulting in an outer portion of each fluke having a flap-member. The flap-like member or fin is turned downwardly extending the view that it resembles a flap. The flap gives the ability of the anchor to achieve horizontal travel as it is pulled through a mooring bottom.

The arcuate trailing edge assists in preventing the anchor from lying on its back. It has been found that the shank should extend upwardly for a sufficient height to keep the anchor from lying on its back and low enough to be able to turn right side up when the anchor starts from a point of lying on its side.

DETAILED DESCRIPTION OF THE INVENTION

Figure 1:
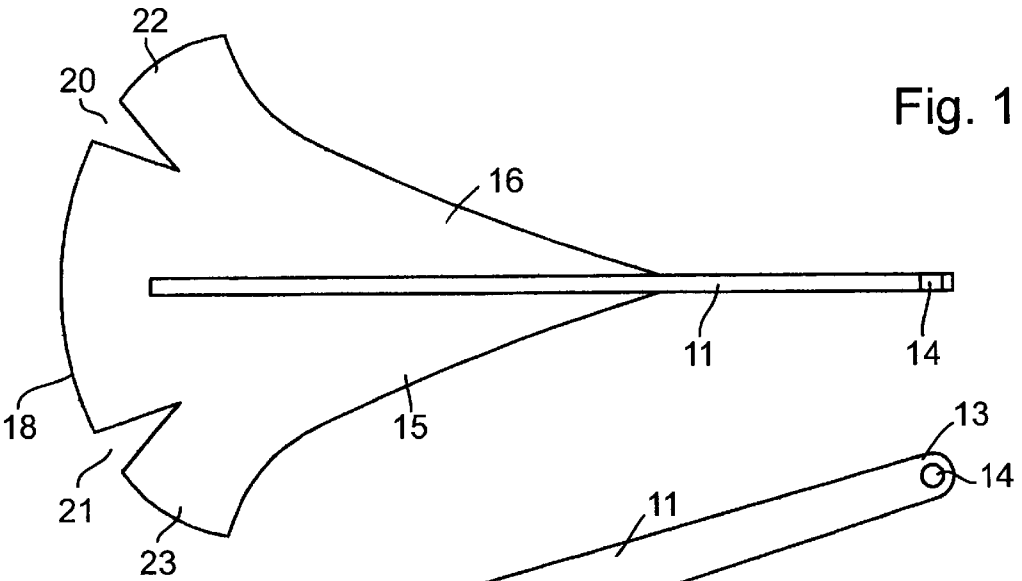
FIG. 1 is a top view of the anchor of the present invention.
Figure 2:
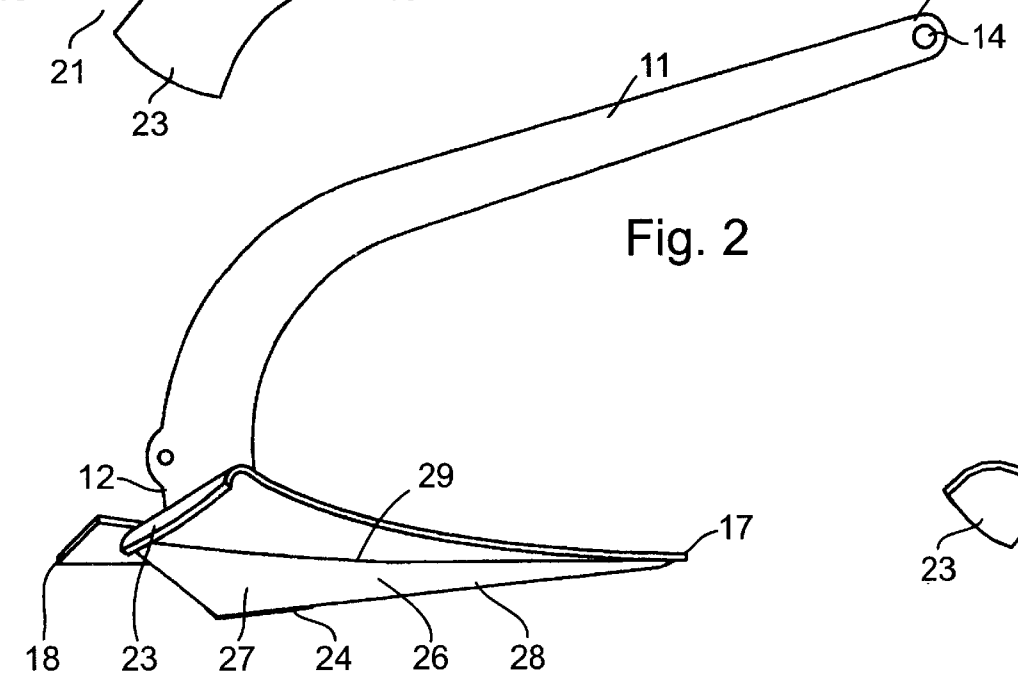
FIG. 2 is a side view of the anchor.
Figure 3:
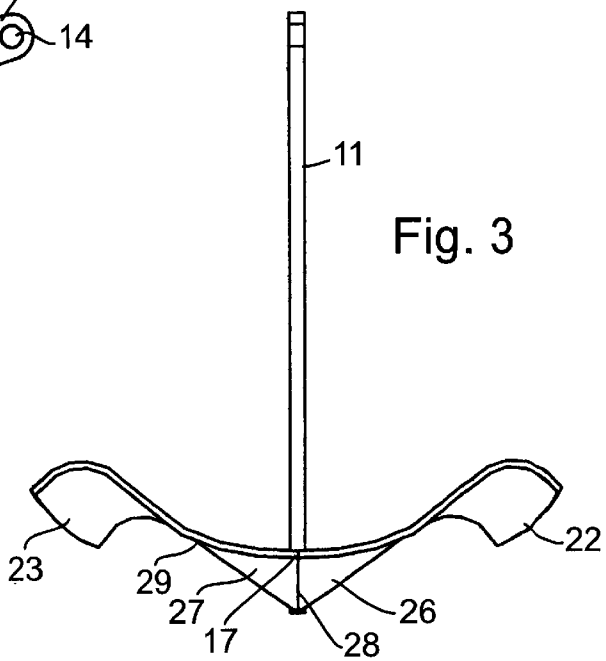
FIG. 3 is a first view of the anchor.

Attention is directed to FIGS. 1–3, where 10, refers generally to the anchor. The anchor 10 has has a shank 11 which has a first end 12 and a second end 13. The second end 13 has a bore 14 to which a line may be affixed. The first end 12 is attached to flukes 15 and 16 which are affixed to each other. The flukes 15 and 16, together describe a delta configuration terminating in a forwardly extending point 17.

The delta flukes 15 and 16 have an arcuate trailing edge 18. Each of the flukes have a pie shaped wedge portions 20 and 21 removed. The resultant is a fin 22 of fluke 16 and a fin 23 of fluke 15. Each of the fins 22 and 23 are bent towardly to depict a flap like configuration.

The bottom of the anchor has an elongated downwardly extending V-shaped portion 26 which acts as a flow. It is constructed of a sheet 27 having an elongated fold 28. Each of the edges 29 of the sheet 27 is attached to the underside of the flukes by suitable means.

The bottom of the anchor has a skeg 24.

The anchor 11 is constructed of metal.

Figure 5:
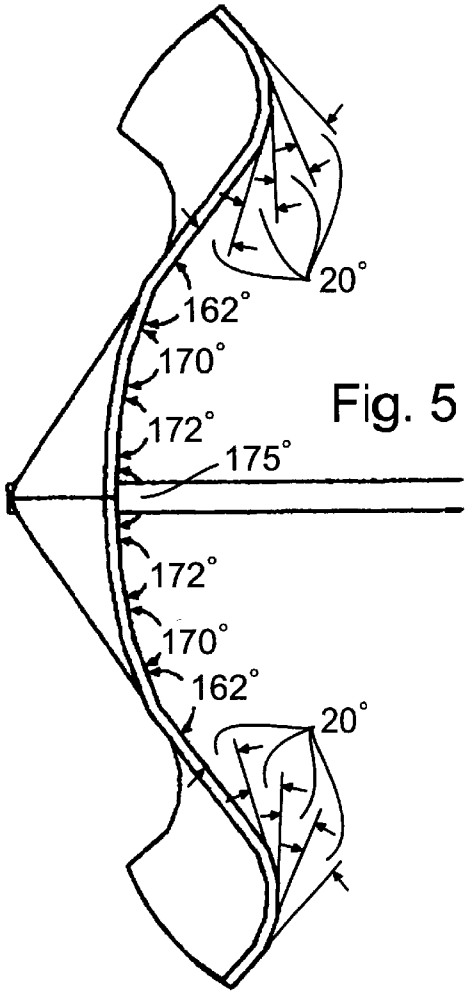
FIG. 5 is view of from the print showing angularly of the bends.
Figure 4:
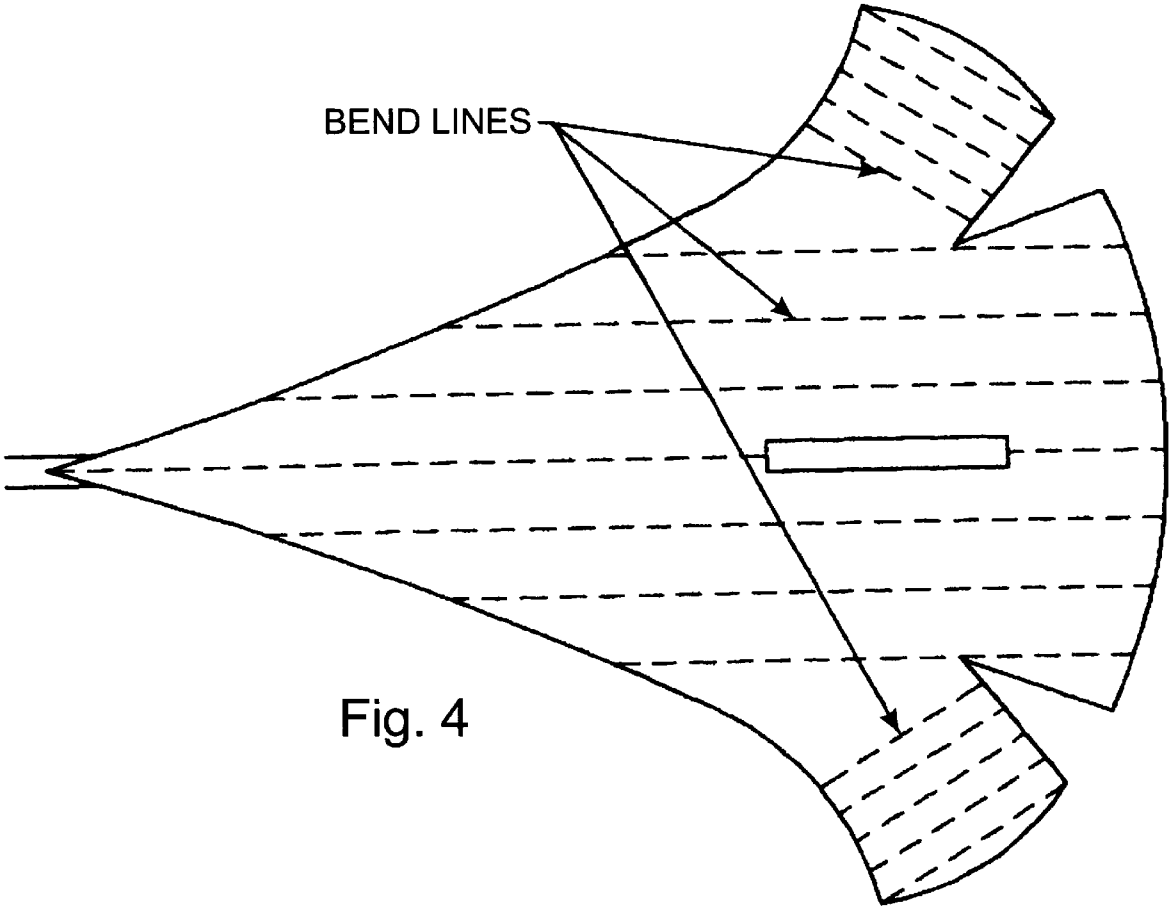
FIG. 4 is a top view of the anchor showing the bend lines which are dashed.

As the degree of bending the anchor has importance attention is directed to FIGS. 4 and 5 for a teaching to show bend lines in dotted form super-imposed on the anchor, as shown in FIG. 4. In FIG. 5 a front view of the anchor shows the degree of bending achieved about the bend lines of FIG. 4.

Figure 6:
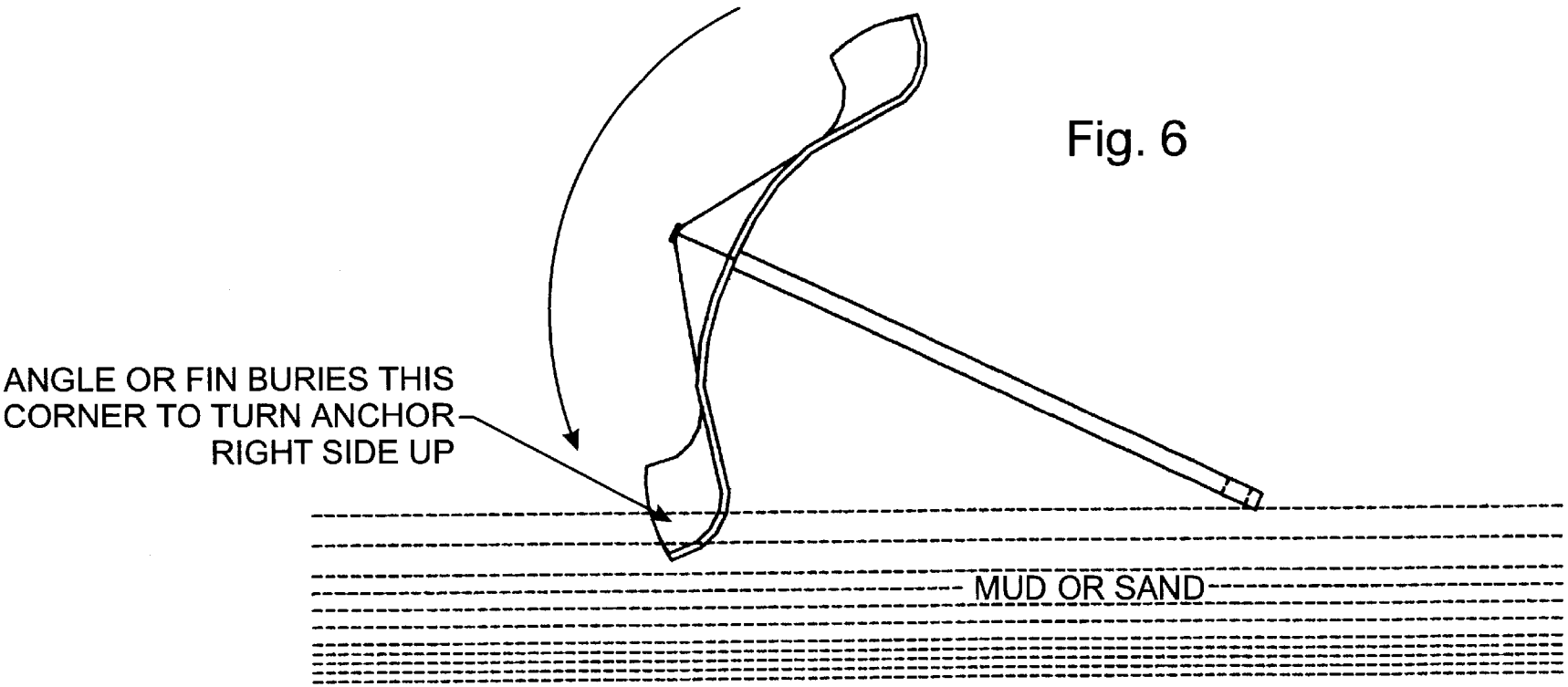
FIG. 6 shows the anchor on mud or sand shown in dotted lines.

Attention is now directed to FIG. 6 which shows the anchor from the front in a just deposited position on a bed of mud or sand. The dotted lines depicting a variable density of sand or mud. The FIG. 6 shows the fin of one fluke of the anchor somewhat embedded in the bottom. When the anchor is pulled through a line to the bore 14 the anchor rotates counter clockwise as shown by the arrow to a position whereby the point 17 digs into the bottom upon further travel.

Figure 7:
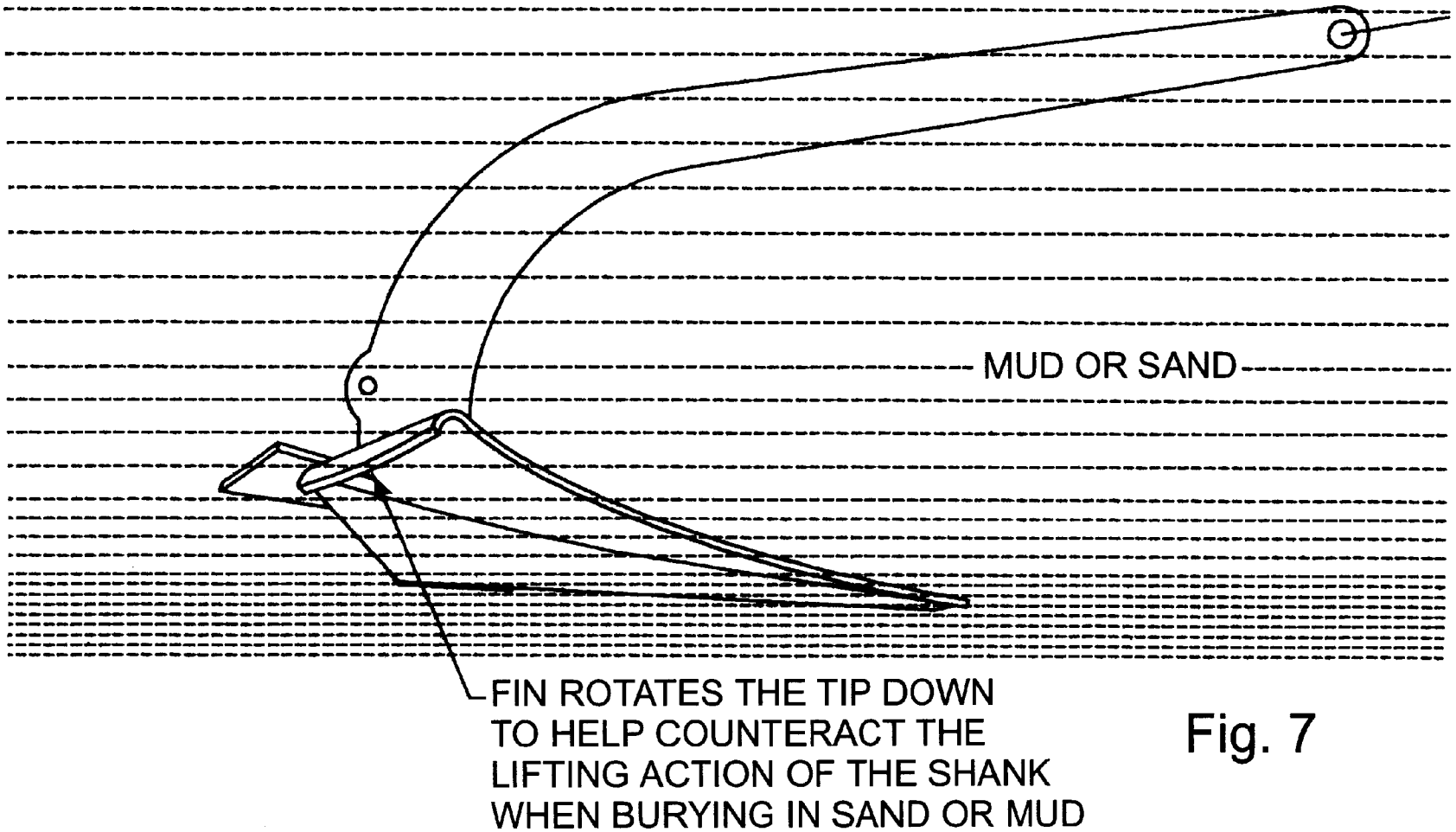
FIG. 7 shows the anchor being pulled

In FIG. 6 the fin has its corner buried which then turns the anchor right side up as it is pulled to the position shown in FIG. 7 where the fin rotates point 17 downwardly to help counteract the lifting action of the shank when burying in sand or mud.

Figure 8:
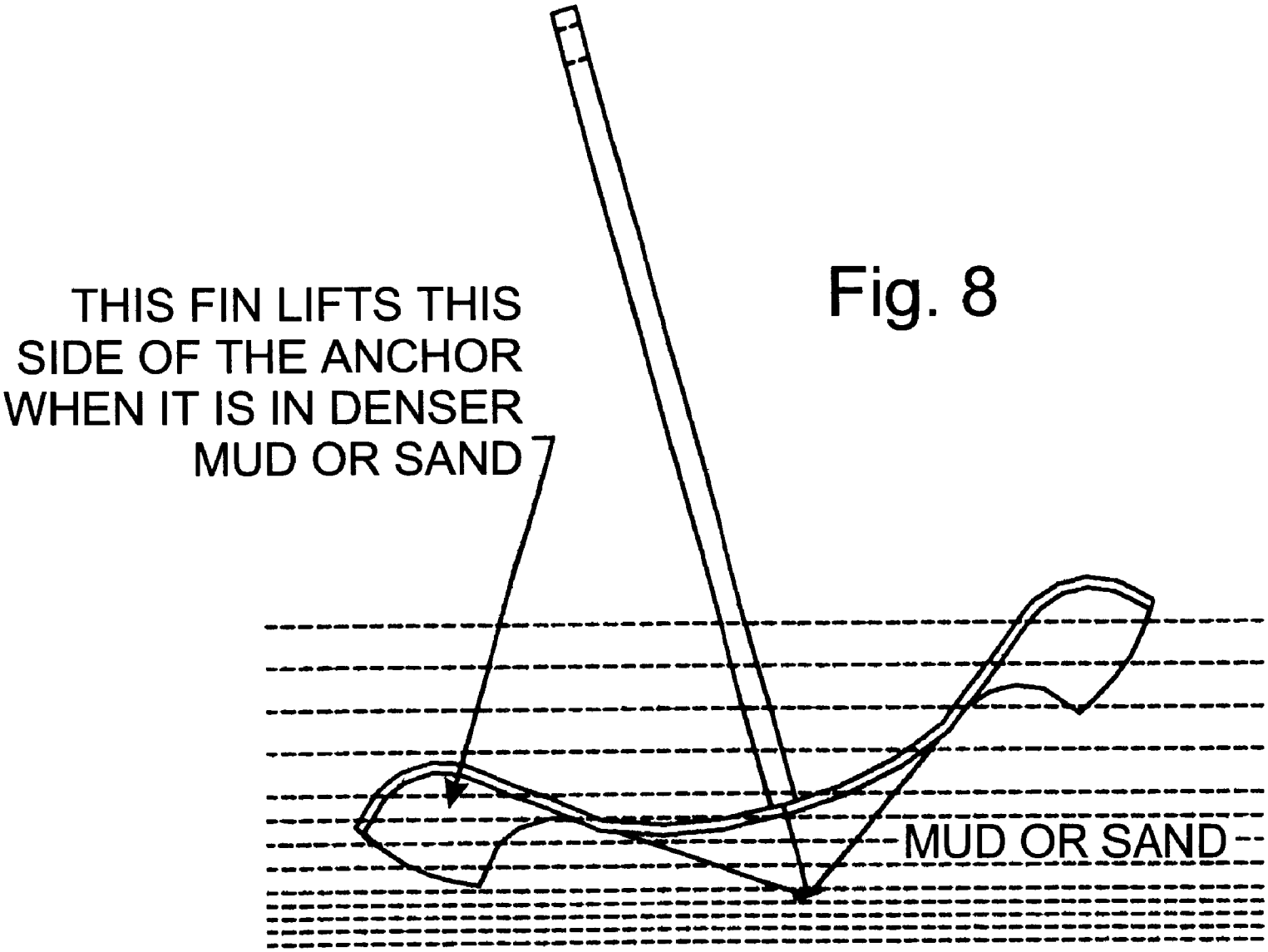
FIG. 8 shows the anchor being displaced into a horizontally mode.

In FIG. 8, which is a front view, the fin is shown as a lifting means when the anchor is at the angle shown, thereby the lower fin is in denser mud or sand and the fin has greater lift resulting in making the anchor desirably more horizontal.

The present invention discloses an anchor which is self-righting and which can provide high holding capacity exceeding by its own weight by a considerable factor in both firm sand and soft mud without the need of fluke angle adjustment.

What is claimed is:

1. A marine anchor, symmetrical about a fore-and-aft plane, including a basic anchor structure comprising:

an arcuate shank having a first end and a second end, a pair of arcuate triangular flukes positioned on opposite side of said first end of said arcuate shank, said flukes terminating in a mutually forwardly extending point, said shank extending perpendicularly upwardly and forwardly from said pair of flukes, said second end of the shank extending forward substantially beyond said forwardly extending point of said flukes;

said shank terminating in an anchor line attachment point at said second end, said first end of said shank being affixed to said flukes at a point rearwardly from said forwardly extending point at substantially aft of a mid-point of said flukes, said flukes having an arcuate rearwardly extending trailing edge, each of said flukes having a wedge shaped cutout at said trailing edge resulting in each fluke having an outer fin that is separate from a main portion of each fluke, said outer fin of each fluke being arcuately bent downwardly in a preselected bending pattern.

2. The anchor of claim 1 wherein the shank approximately is at an angle with respect to said flukes.

3. The anchor of claim 1 wherein the said fins are bent in increments of 20°.

4. The anchor of claim 1 wherein the flukes together are arcuate with a downward apex being centered about the first end of the shank.

5. The anchor of claim 1 wherein the anchor has a bottom and a V-shaped wedge portion is attached to the bottom from the said point rearwardly to approximately to where the first end of the shank meets the flukes.

* * * * *